United States Patent [19]

Neyret

[11] 3,985,493

[45] Oct. 12, 1976

[54] CIGARETTE LIGHTER WITH AUTOMATIC GAS SHUTOFF

[75] Inventor: Guy Neyret, Francheville, France

[73] Assignee: Societe Anonyme dite: Etablissements Genoud & Cie., Vennissieux, France

[22] Filed: Sept. 18, 1975

[21] Appl. No.: 614,620

[30] Foreign Application Priority Data

Sept. 24, 1974 France ..... 74.32783

[52] U.S. Cl. ..... 431/150; 431/21; 431/131

[51] Int. Cl.[2] ..... F23Q 2/00

[58] Field of Search ..... 431/130, 131, 149, 150, 431/21, 23

[56] References Cited

UNITED STATES PATENTS

| | | | |
|---|---|---|---|
| 2,264,804 | 12/1941 | Rabinowicz | 431/23 |
| 2,728,213 | 12/1955 | Quercia et al. | 431/131 |
| 2,950,755 | 8/1960 | Frecourt | 431/21 |

*Primary Examiner*—Edward G. Favors
*Attorney, Agent, or Firm*—Karl F. Ross; Herbert Dubno

[57] ABSTRACT

A lever formed at least partially as a bimetallic strip engages between the cover and the burner-valve of a gas-type cigarette lighter. When the cover is lifted this lever automatically opens the valve and forms a gas jet that may be ignited with the striker. A cup-shaped extension on the lever at the jet is heated by the flame on the lighter and conducts this heat to a thermodeformable tab on the lever so that after a predetermined amount of heating the tab deforms and disconnects the lever from the burner-valve, allowing this valve to close and shut off the gas flow.

7 Claims, 4 Drawing Figures

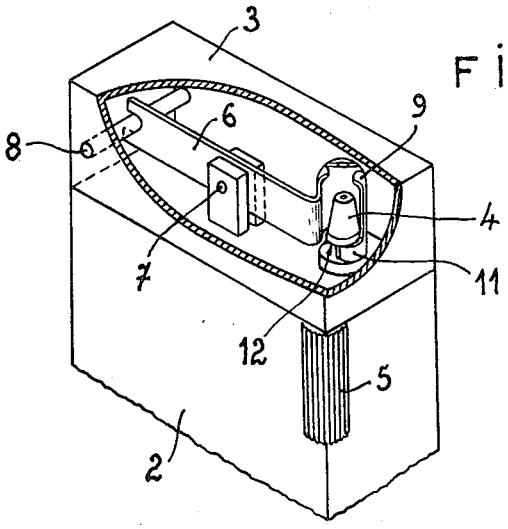
FIG. 1
FIG. 4
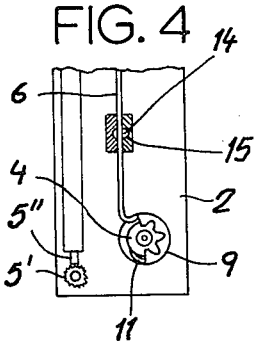
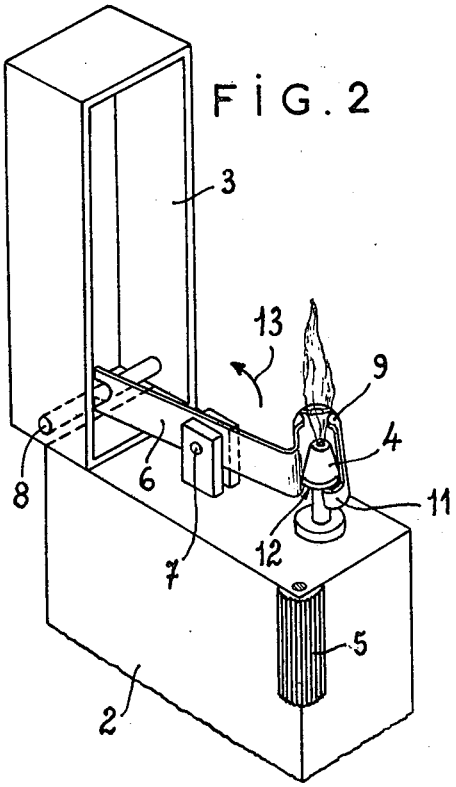
FIG. 2
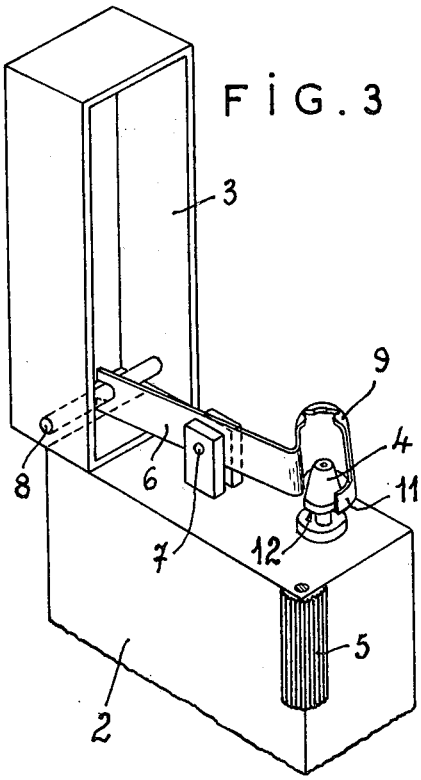
FIG. 3

CIGARETTE LIGHTER WITH AUTOMATIC GAS SHUTOFF

FIELD OF THE INVENTION

The present invention relates to a lighter for cigarettes, cigars, and the like. More particularly this invention concerns a gas-type lighter of the type having a cover or lid which normally covers the burner.

BACKGROUND OF THE INVENTION

A gas-type lighter of the type having a cover which normally encloses the burner and striker mechanism is usually set up such that the valve is opened automatically when the cover is displaced into the open or up position. Thus the user need merely open his lighter and operate the stroker wheel to obtain a light.

The main disadvantage of this system is that the gas continues to escape until the cover is closed. Thus if the lighter is set down while ignited a fire hazard is created, as it will continue to burn until all the gas fuel is exhausted.

OBJECTS OF THE INVENTION

It is therefore an object of the present invention to provide an improved lighter.

Another object is the provision of a lighter of the type wherein opening of the cover automatically opens the gas valve, but wherein the above-described fire hazard is not present.

SUMMARY OF THE INVENTION

These objects are attained in accordance with the present invention in which the lid is provided with a lever formed at least partially of heat-sensitive or thermodeformable material pivoted on a fixed pin parallel to the pivot pin for the lid and supported by the body of the lighter. One of the ends of this lever is provided with a cap able to partly enclose the burner valve and thus pick up and transmit heat liberated by the flame of this burner and with a hook able to engage underneath a shoulder of the burner valve. This hook is disengaged from the burner when it deforms due to the heat of the flame. The other end of the lever is connected to the lid in order that operation of the latter causes it to tilt in the direction for opening the valve or closing it depending on whether it is raised or lowered.

Thus, if, after having ignited the flame, the user puts his lighter down without having closed its lid or cover, the heat of the flame is transmitted by the cup to the hook of the lever whose heat sensitive nature causes it to deform. The hook thus releases the valve which, biased toward its closed position by its spring, causes the flame to be extinguished by cutting off the flow of gas.

In order to relight his lighter, the user must first lower the lid of the latter into the closed position in order to allow, after its cooling, reengagement of the hook under the shoulder of the burner-valve.

According to this invention the end of the heat-sensitive lever by which the body is connected to the lid constitutes the bearing for the pivot pin of the latter.

The pin to which the lever associated with the lid is pivoted, may be constituted by a rod or even by bosses engaged in hollows respectively provided in the upper part or head of the lighter and in the lever or vice versa.

BRIEF DESCRIPTION OF THE DRAWING

The above and other objects, features, and advantages will become more readily apparent from the following, reference being made to the accompanying drawing in which:

FIG. 1 is a perspective view showing the lighter closed and partly broken away, the striker mechanism not illustrated for the sake of clarity;

FIGS. 2 and 3 show in perspective view the lighter with the burner-valve open and closed, respectively; and FIG. 4 is a top view of a detail of another lighter according to this invention.

SPECIFIC DESCRIPTION

This lighter is of the type comprising a body 2 equipped with a hinged lid 3 which, in the closed position, covers and encloses the burner-valve 4.

This drawing illustrates in FIGS. 1–3 solely the driving member 5 for the striker wheel, but not the knurled wheel itself, nor the flint support. FIG. 4 shows the stroker wheel 5 and the flint 5''.

In this type of lighter, in which the burner valve 4 must be moved vertically upwards (or vertically downwards) for opening the valve, a lever 6 is provided pivoted on a pin 7 fixed on the body 2 of the lighter and parallel to the pivot pin 8 for its lid 3 in order to control opening of the burner valve 4 by the opening movement of the lid 3. Conversely, closing the lid 3 controls the closure of the burner valve 4 by means of the same lever 6.

In the example illustrated in the drawings, the end by which the lever 6 is connected to the lid 3 constitutes the bearing for the pivot pin 8 of the latter.

In known lighters of this type, when the user puts the lighter down without reclosing the lid, the flame will remain lit until the gas contained in the reservoir of the lighter is exhausted, which under certain circumstances may cause considerable risk.

In the lighter according to the invention, this risk is eliminated. For this purpose, the end of the lever 6 opposite that by which it is connected to the pivot pin 8 for the lid 3 is formed as a cylindrical cup 9 which, both in the inoperative position and the lit position as illustrated in FIGS. 1 and 2, partly surrounds the burner valve 4 and a hook 11 able to engage normally under a shoulder 12 provided for this purpose under the head of the burner valve 4.

Furthermore, at least this end of the lever 6 is used as a bimetallic strip, so that after being heated the hook-shaped part 11 tends to open out and disengage itself from the shoulder 12, thereby releasing the burner valve 4 as illustrated in FIG. 3.

The operation of this lighter is thus as follows:

In the closed inoperative position such as that illustrated in FIG. 1, the hook 11 of the lever 6 is engaged under the shoulder 12 of the burner valve 4, but the latter is in the closed position, since the lid 3 is also in the closed position.

Opening the lid 3 tilts the lever 6 in the direction of arrow 13 and raises the burner valve 4 to open the gas outlet. Thus, by actuating the striker wheel 5 the user may light his lighter as illustrated in FIG. 2.

The cylindrical cup 9 of the lever 6 is thus exposed to the flame of the lighter and as it is heated transmits the heat to the hook 11 whose deformation causes the release and consequent liberation of the burner valve, which has the effect of extinguishing the flame.

An examination of FIG. 3 shows that in order to relight his lighter, the user must necessarily and previously restore the lid 3 to the closed position in order to ensure that after cooling the hook 11 is reengaged under the shoulder 12 of the burner valve.

Naturally, the invention is not limited to the single embodiment of this lighter which was described above as a nonlimiting example. On the contrary, it includes all variations. Thus, as shown in FIG. 4, the pivot pin 8 common to the lever 6 and lid 3 may be replaced by bosses 14 and hollows 15 provided respectively at the relevant end of the lever 6 and in the upper part or head of the lighter or vice versa.

I claim:

1. A lighter comprising:

a reservoir body, a burner-valve on said body displaceable between an open position allowing gas to escape from said body to form an ignitable jet and a closed position preventing such escape, a cover on said body displaceable between a down position enclosing said burner-valve and an up position uncovering said burner valve, means including a lever pivoted on said body and having a thermodeformable portion for engaging between said cover and said burner-valve only when said portion is relatively cool to displace said burner-valve into said open position on displacement of said cover into said up position and for disengaging said cover from said burner-valve when relatively hot, and means for conducting heat from a flame formed at said jet to said thermodeformable portion.

2. The lighter defined in claim 1, further comprising means for urging said burner-valve into said closed position, whereby when said portion is relatively hot and disengages said cover from said burner-valve, said burner-valve automatically returns to said closed position.

3. The lighter defined in claim 2 wherein said means for conducting is a cup-shaped extension on said lever normally engaging over said burner-valve.

4. The lighter defined in claim 3 wherein said burner-valve is formed with a shoulder and said portion is bimetallic and forms a tab engaging under said shoulder when relatively cool.

5. The lighter defined in claim 4 wherein said cup-shaped extension is laterally open and partially surrounds said burner-valve.

6. The lighter defined in claim 4 wherein said reservoir is provided with a pivot for said lever.

7. The lighter defined in claim 6 wherein said lever is provided with a pivot for said cover.

* * * * *